US007039211B2

(12) United States Patent
Werner

(10) Patent No.: US 7,039,211 B2
(45) Date of Patent: May 2, 2006

(54) HORN-LOADED COMPRESSION DRIVER SYSTEM

(75) Inventor: Bernard M. Werner, Los Angeles, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 218 days.

(21) Appl. No.: 10/401,817

(22) Filed: Mar. 28, 2003

(65) Prior Publication Data

US 2003/0215107 A1 Nov. 20, 2003

Related U.S. Application Data

(60) Provisional application No. 60/368,505, filed on Mar. 28, 2002.

(51) Int. Cl.
*H04R 25/00* (2006.01)

(52) U.S. Cl. ..... 381/343; 381/339; 381/340

(58) Field of Classification Search ..... 381/337–343, 381/423–424; 181/152, 159, 160, 177, 185, 181/187, 192–196
See application file for complete search history.

(56) References Cited

U.S. PATENT DOCUMENTS

| | | | | |
|---|---|---|---|---|
| 2,183,528 | A | 12/1939 | Blackburn | |
| 4,050,541 | A | 9/1977 | Henricksen | |
| 4,157,741 | A | 6/1979 | Goldwater | |
| 4,525,604 | A | 6/1985 | Frye | |
| 4,628,155 | A | 12/1986 | Robineau et al. | |
| 4,975,965 | A | 12/1990 | Adamson | |
| 5,117,462 | A * | 5/1992 | Bie | 381/343 |

OTHER PUBLICATIONS

Smith, Bob H., "An Investigation of the Air Chamber of Horn Type Loudspeakers," *The Journal of The Acoustical Society of America*, vol. 25, No. 2, Mar. 1953, pp. 305-312.

* cited by examiner

*Primary Examiner*—Suhan Ni
(74) *Attorney, Agent, or Firm*—Brinks Hofer Gilson & Lione

(57) ABSTRACT

A horn-loaded compression driver or a loudspeaker has a phasing plug with multiple slots and a common annular chamber. The slots extend from an inlet side to the common annular chamber, which extends to an outlet side. Each slot has a path length extending to a common focal point in the common annular chamber. The common focal point has a common path length extending to the outlet side. The phasing plug provides an approximately flat acoustic wave front from the compression driver to the horn.

23 Claims, 2 Drawing Sheets

HORN-LOADED COMPRESSION DRIVER SYSTEM

CROSS REFERENCE TO RELATED APPLICATIONS

This application is based on Provisional Application Ser. No. 60/368,505 entitled "HORN-LOADED CONE COMPRESSION DRIVERS" filed on Mar. 28, 2002. The benefit of the filing date of the Provisional Application is claimed for this application.

BACKGROUND OF THE INVENTION

1. Technical Field

This invention relates generally to loudspeakers. More particularly, this invention relates to loudspeakers having a compression driver with a horn, where the compression driver has a phasing plug.

2. Related Art

Loudspeakers transform electrical signals into sound. Many loudspeakers have a compression driver with a horn. The compression driver usually is a transducer having a diaphragm with a voice coil immersed in the magnetic field of a permanent magnet. The diaphragm vibrates when electrical signals are applied to the voice coil. The vibrations of the diaphragm compress air to produce sound from the loudspeaker. The diaphragm may be flat, concave, convex, or a combination. The diaphragm may comprise paper, cloth, plastic, metal, ceramic, or a combination of materials. The horn is a tube with increasing cross-section across its axis, thus forming a flared, conic configuration. The horn's narrow inlet or throat is connected to the compression driver. The horn's wide outlet is for projecting sound. The horn generally acts as a waveguide to direct the pattern of sound waves from the compression driver. These horn-loaded compression drivers may be designed specifically to provide low, high, or midrange sound frequencies.

Many horn-loaded compression drivers have a phasing plug between the diaphragm and the horn. The phasing plug is positioned adjacent to the diaphragm with sufficient space so the phasing plug does not interfere with the diaphragm as it vibrates. The phasing plug has a surface facing the diaphragm that generally conforms or lays parallel to the surface of the diaphragm. The phasing plug also has an opposing surface facing the throat of the horn. The phasing plug typically has circumferential slits, radial slits, or holes that form an acoustic path for transfer of the sound energy from the compression driver to the horn. This acoustic path should compresses audio signals from the compression driver and equalizes path lengths of the sound waves to reduce out of phase and destructive interference.

Horn-loaded compression drivers have several performance advantages including increased sensitivity, desirable pattern control, arrayability (easier driver arrangement in a speaker enclosure), reduced harmonic and intermodulation distortion, and higher maximum sound pressure level (SPL). However, these advantages often are difficult to achieve due to limitations in the practical implementation of an effective phasing plug, especially in loudspeakers designed for midrange sound frequencies. Phasing plugs usually do not provide a satisfactory and/or complete transformation of the acoustic signals from the compression driver to the horn. These limitations result in poor frequency response characteristics, restricted bandwidth in the upper frequency range, and non-ideal area expansions that introduce audible response irregularities such as the "horn midrange sound" in midrange loudspeakers having horn-loaded compression drivers.

SUMMARY

This invention provides a horn-loaded compression driver or a loudspeaker with a phasing plug that provides an approximately flat acoustic wave front from the compression driver to the horn. The phasing plug has multiple slots extending from an inlet side to a common annular chamber, which extends to an outlet side. Each slot has a path length extending from the inlet side of the phasing plug to a common focal point in the common annular chamber. The common focal point has a common path length extending to the outlet side of the phasing plug. The phasing plug directs sound waves produced by a diaphragm in the transducer to the throat of the horn.

A horn-loaded compression driver system may have a phasing plug disposed between a horn and a diaphragm in a transducer. The phasing plug has multiple annular rings forming multiple slots and a common annular chamber. Each slot has a path length extending to a common focal point in the common annular chamber. The common focal point has a common path length extending to the horn.

A phasing plug for a loudspeaker may have at least three annular rings forming at least two slots and a common annular chamber. Each slot extends from an inlet side to the common annular chamber. The common annular chamber extends from the slots to an outlet side. Each slot has a path length from the inlet side to a common focal point in the common annular chamber. The common annular chamber has a common path length from the common focal point to the outlet side.

A loudspeaker may have a transducer and a phasing plug. The transducer is connected to a horn. The transducer has a diaphragm. The phasing plug is positioned between the transducer and the horn. The phasing plug has an inlet side and an outlet side. The inlet side is adjacent to the diaphragm. The outlet side is adjacent to the horn. The phasing plug forms at least two slots and a common annular chamber. Each slot has a path length from the inlet side to a common focal point in the common annular chamber. The common annular chamber has a common path length from the common focal point to the outlet side.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
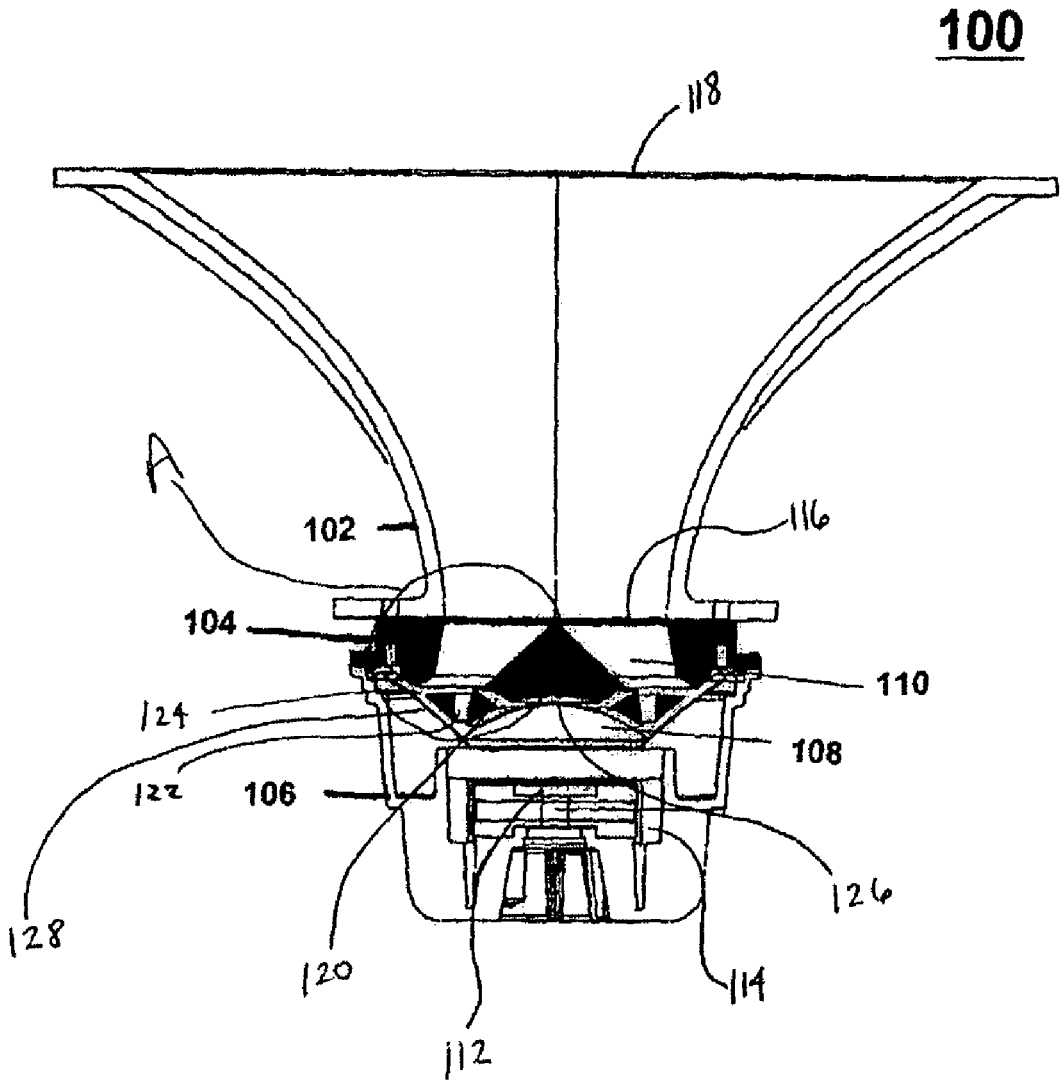
FIG. 1 is a cross sectional view of a horn-loaded compression driver.

FIG. 1 is a cross sectional view of a horn-loaded compression driver or loudspeaker 100 having a horn 102, a phasing plug 104, and a transducer 106. The horn 102 has a hollow, flared cylinder configuration with increasing cross-sectional area from a throat or input 116 to a mouth or output 118. The transducer 106 includes a diaphragm or cone 108, a voice coil 112, and a permanent magnet 114. The diaphragm 108 may be flat, concave, convex, or a combination such as a domed center portion or dust cap 126 positioned within a conical outer portion 128. The voice coil 112 is located within the magnetic field of the magnet 114. The phasing plug 104 is disposed adjacent to the diaphragm 108. The phasing plug 104 has a surface that conforms or lays parallel to the diaphragm and an opposing surface that forms the common annular chamber 110. The common annular chamber 110 is formed by the phasing plug 104, but may be formed by the transducer 106, an extension of the horn 102, or another component. The phasing plug 104 has multiple slots 120, 122, and 124 for directing sound waves from the diaphragm 108 to a common focal point in the common annular chamber 110. The phasing plug 104 and transducer 106 are connected to the horn 102 such that the common annular chamber 110 of the phasing plug 104 is disposed adjacent to the throat 116. The loudspeaker 100 produces sound when an electrical potential is applied to the voice coil 112. The loudspeaker 100 may be designed to provide low, high, midrange or a combination of sound frequencies. The loudspeaker 100 may have other configurations, including those with fewer or additional components.

The horn 102 is a wave guide for directing the sound waves produced by the transducer 106. The horn 102 may be any type of horn or waveguide which has a smaller opening at the input end or throat 116 and a larger opening at the output end or mouth 118. Sound waves are produced by the diaphragm 108 and travel through the phase-plug 104. The sound waves enter the throat 116 and exit the mouth 118. The horn 102 may have a circular throat with a larger mouth having a gradual taper joining the throat and mouth. The horn 102 may have other shapes and designs, such as a rectangular configuration.

The phase-plug 104 is disposed adjacent to the throat 116. The transducer 106 is operatively mounted at the throat 116 of the horn 102. Operatively mounted includes connecting the transducer 106 at the throat 116 of the horn 102 in a fashion that permits sound waves to move from the transducer 106, through the phase-plug 104, and into the throat 116 of the horn 102. The transducer 106 may be coupled directly to the horn 102. The transducer 106 may be coupled to a portion of the phasing plug 104 that is coupled at the throat 116 of the horn 102.

The horn 102 may have a smaller opening forming a throat that is circular and about 4 inches in diameter. The throat may have other sizes, dimensions, and configurations. A throat having a diameter of about 4 inches may improve loading because of the exponential growth of the sound wave, as generated by the transducer and the phase plug, is at a better compression ratio for high sensitivity. A throat having a diameter of about 4 inches may provide constant coverage that reduces acoustic anomalies and distortion and may provide relatively uniform coverage and directivity when compared to throats having diameters of 2 and 3 inches. Additionally, because the sound wavefront provided by the phase plug is approximately flat when it enters the horn through the throat, improved dispersion and on- and off-axis coherency results. The distortion of a throat having a diameter of about 4 inches can be as low as the distortion of a driver with a 5.5 inch diameter throat and no phase plug cavity, but with about 3–5 dB improvement in sensitivity.

The transducer 106 may be any type that converts electrical energy into mechanical or acoustical energy. The transducer 106 incorporates a diaphragm or cone 108 that is anchored at the perimeter to a frame or outer wall of the transducer 106. The diaphragm is anchored by a flexible material, such as foam, rubber, or cloth. The voice coil 112 is attached to the diaphragm 108 at the center or another location. The voice coil is cylindrical and is wrapped with an insulated wire. The insulated wire coil resides within a magnetic field provided by the permanent magnet 114, which may comprise neodymium or other suitable material. By applying a voltage to the wire coil, an electrical field is generated that interacts with the magnetic field of the magnet 114, causing the voice coil 112 to vibrate or move in a linear fashion. This linear movement of the voice coil 112 causes the attached diaphragm 108 to also move linearly or vibrate, thus producing a sound wave.

The transducer 106 may have a diaphragm 108 ranging from about 4 inches to about 15 inches in diameter. The diaphragm 108 may be flat, concave, convex, or a combination of the shapes. Convex and concave are in relation to the permanent magnet 114. The diaphragm 108 may have other sizes, dimensions, and configurations.

The diaphragm 108 may be made of any material or combination of materials that provides suitable rigidity for the vibrating environment. These materials include paper, doped paper, metal, plastic, and fiber such as a carbon fiber like KEVLAR®. The transducer 106 may incorporate various methods to prevent heat build up, including a thermally conductive rear chamber that is sized to reduce acoustical reactance.

Figure 2:
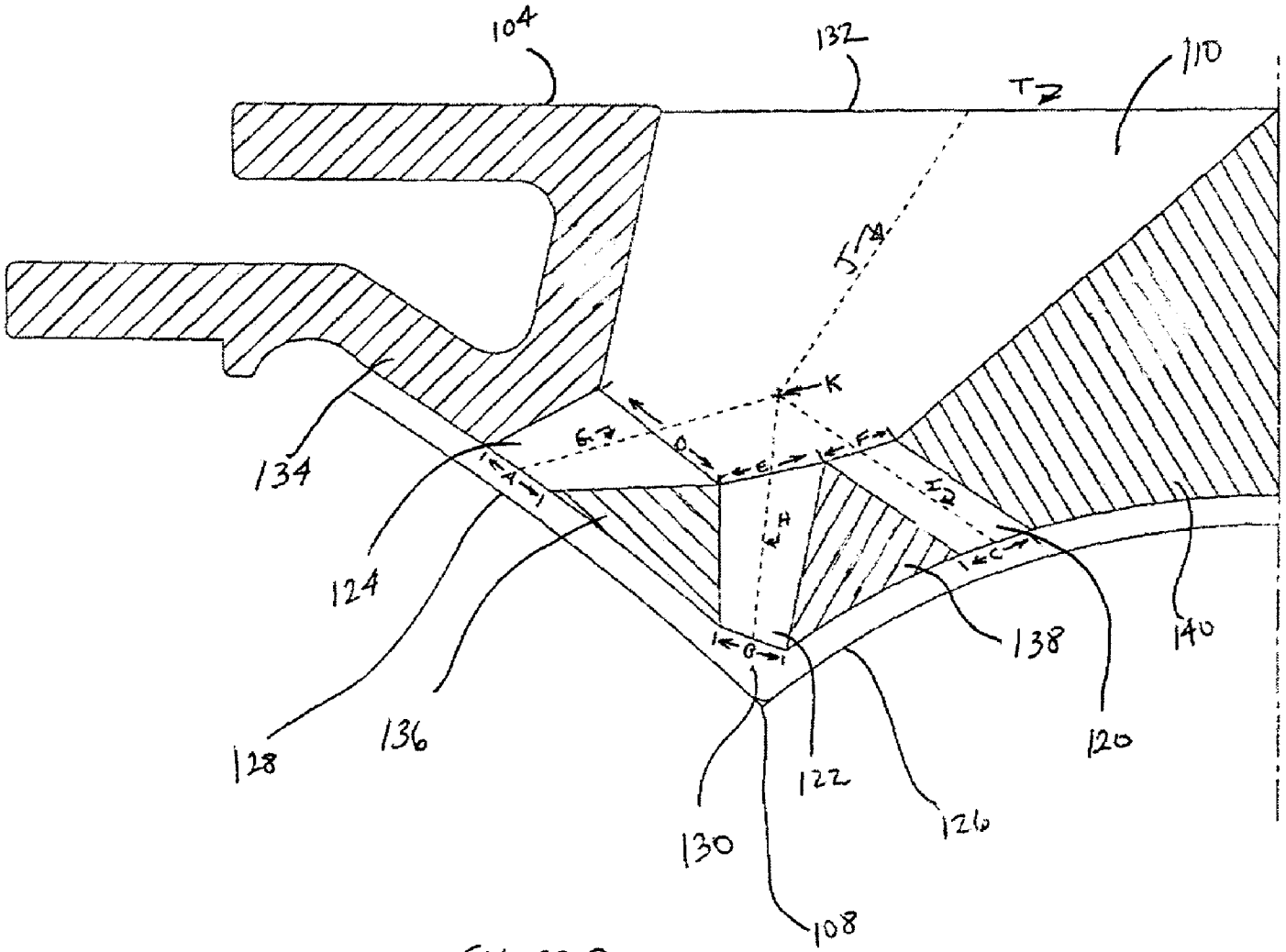
FIG. 2 is a close-up view of a phasing plug along section A of the horn-loaded compression driver shown in FIG. 1.

FIG. 2 is a close-up view of phasing plug 104 along section A of the horn-loaded compression driver 100 shown in FIG. 1. The phasing plug 104 has an input side 130 and an output side 132. The input side 130 is disposed adjacent to the diaphragm 108. The output side 132 is disposed adjacent to the throat 116 of the horn 102. The phasing plug 104 may be spaced between about 0.008 inch to about 0.250 inch from the diaphragm 108. The phasing plug 104 may be spaced about 0.075 inch from the diaphragm 108. The phase plug 104 and the diaphragm 108 may have other spacing.

The phasing plug 104 has annular rings 134, 136, 138 and 140 that form slots 120, 122, and 124 providing for air movement between the diaphragm 108 and the throat 116 of the horn 102. The support annular ring 134 and the outer annular ring 136 form the outside slot 124. The support annular ring 134 also is configured to connect the phasing plug 104 to the transducer 106 and/or the horn 102. The outer annular ring 136 and the inner annular ring 138 form the center slot 122. The inner annular ring 138 and the center annular ring 140 form the inside slot 120. The center annular ring 140 also is configured to form the center portion of the phasing plug 104. The center annular ring 140 conforms to the shape of the diaphragm 108 and extends to near or about the throat 116 of the horn 102. The phasing plug 104 may have other multiples, including fewer and additional, annular rings and slots. There may be three to ten annular rings along with the corresponding number of slots. There may be four annular rings that provide three slots. There may be three or four slots to provide optimal loading of the diaphragm 108 at frequencies ranging from at about 4 kHz to about 87 kHz. The annular rings each may be an individual piece or they may be joined to maker larger components that include multiple rings to aid in manufacturing. The annular rings may be connected radially by a rib section or other support structure. The phasing plug 104 may have a three slot design in which the annular rings are rigidity bonded together to maintain extremely close dimensional tolerances in production. The phasing plug 104 may be die-cast or molded in a high density polyester-fiberglass thermoset composite, metal, polystyrene foam, a combination, or other moldable material.

The slots 120, 122, and 124 formed by the annular rings 134, 136, 138, and 140 expand uniformly in cross-sectional area as the distance from the diaphragm 108 increases. The slots may have straight (linear) or curved sidewalls. The centerline of each slot is about normal to the diaphragm 108. The sidewalls and centerlines may have other configurations. The annular rings 134, 136, 138, and 140 also form the common annular chamber 110, which is disposed adjacent to the throat 116 of the horn 102. The common annular chamber 110 may be formed by another component of the loudspeaker 100. The common annular chamber 110 may be formed where the expanding slots 120, 122, and 124 overlap or intersect. The common annular chamber 110 expands uniformly in cross-sectional area as the distance from the diaphragm 108 increases. As the distance from the diaphragm 108 increases, the cross-sectional area of the chamber also increases, until the exit or output side 132 of the phasing plug 140 is reached. The distance from the cone includes the distance a sound wave travels away from the surface of the diaphragm 108. The cross-sectional area of the common annular chamber 110 includes the area of a plane parallel to the largest dimension of the diaphragm 108 as defined by an interior region or input side 130 of the phasing plug 104.

The phasing plug 104 is disposed between the horn 102 and transducer 106 to couple the output of the transducer 106 to the surrounding environment and to control the pattern of sound dispersed by the loudspeaker 100. The compression ratio and acoustic flare rate of the phasing plug 104 function in unison to improve or maximize the power ratio of acoustic output to electrical input (in units of acoustical watts divided by electrical watts) of the loudspeaker 100. The volume of air displaced by the annular rings 134, 136, 138 and 140 of the phasing plug 104 removes the effect of an acoustic cavity resonance that otherwise results when a transducer is attached directly to a horn and/or the diameter of the diaphragm is greater than the diameter of the throat of the horn. The location and width of the slots 120, 122, and 134 are beneficially designed so that the path length through the slots 120, 122, and 124 in the phasing plug 104 is about constant from any point on the surface of the diaphragm 108 to the exit or output side 132 of the phasing plug 104 (the entrance to the throat 116 of the horn 102). Thus, destructive interference can be reduced between the sound radiated from each slot into the common annular chamber and between the sound radiated from the annular chamber into the throat of the horn.

In FIG. 2, the entrance to each slot 120, 122, and 124 is at the input side 130 of the phasing plug 104. The entrance to each slot 120, 122, and 124 has a width or cross-section A, B, and C, respectively. The entrance area of each slot 120, 122, and 124 may be determined from the respective width or cross-section A, B, and C.

The exit from each slot 120, 122, and 124 is at the entrance to the common annular chamber 110. The exit from each slot 120, 122, and 124 has a width or cross-section D, E, and F, respectively. The exit area of each slot 120, 122, and 124 may be determined from the respective width or cross-section D, E, and F.

Each slot 120, 122, and 124 also has an average path length G, H, and I, respectively. The average path length denotes the respective distance from the entrance of each slot, through the respective slot, to a common focal point K in the common annular chamber 110. The common focal point K is the focal point of the path lengths of each slot 120, 122, and 124 in the annular chamber 110. The average path lengths G, H, and I are about equal. The common focal point K may be located anywhere within the common annular chamber 110. The common focal point K has a common path length J, which denotes the distance from the common focal point K to the exit of the common annular chamber 110, which is at or near the throat 116 of the horn 102. The common path length J is greater than zero. The exit of the common annular chamber has an exit plane T at the exit or outlet side 132 of the phasing plug 104. The area of the exit plant T may be about the same as the area of the phasing plug 104 adjacent to the horn 102. The exit plane T has a length corresponding to the radius of the phasing plug 104 in communication with the throat 116 of the horn 102. The cross-sectional area of the exit of the common annular chamber 110 may be about equal to the cross-sectional area of the throat 116 of the horn 102.

The locations of the entrance to each slot 120, 122, and 124 may be adjusted so that the distance from surface of the diaphragm 108 is approximately equal to a distance of about equal path length between each slot. Then the center lines of each slot 120, 122, and 124 converge at the common focal point K.

The loudspeaker 100 provides increased bandwidth, improved frequency response, and lower harmonic and intermodulation distortion. The loudspeaker 100 extends bandwidth (both up and down in frequency) to cover a vocal range in a relatively seamless fashion. The loudspeaker 100 allows for better horn pattern control by reducing the projection aperture and improves phase coherency of a midrange signal for a clearer, more intelligible audio quality. Additionally, by reducing the amount of diaphragm displacement required to achieve a desired sound pressure level (SPL), distortion may be reduced.

The loudspeaker 100 features a horn that provides optimal arrayability and predictable acoustic performance in various applications. Many of the typical performance and audible limitations associated with horn-loaded compression drivers for midrange applications are eliminated or reduced.

The loudspeaker 100 may allow improved spacing from diaphragm to the phasing plug thus providing better acoustic coupling, lower air volume velocity, and higher pressure at the diaphragm surface. The loudspeaker also may provide lower pressure and higher air volume velocity at the horn mouth with a relatively smooth and desirable exponential or conical transition from the diaphragm to the throat. The loudspeaker 100 provides smoother frequency response, more uniform cone loading that gives a pistonic response, and extended bandwidth. The loudspeaker 100 provides an approximately flat wavefront at the horn throat due to path length compensation. The loudspeaker 100 may be easier to use with varied horn types and especially with horns having a 4 inch throat. The loudspeaker 100 also may provide optimal low frequency loading that increases low frequency bandwidth, along with optimal diaphragm/phasing plug spacing that increases midband sensitivity. The slot gap width and slot location in the phasing plug may be selected to extend high frequency bandwidth because transverse resonances between the diaphragm and phasing plug are shifted to higher frequencies approaching the theoretical limit. The loudspeaker 100 may provide a compression ratio ranging from about 1:7 to 1:8, thus providing low distortion performance that is similar to devices that do not use phase plugs and have a throat diameter of 5.5 inches. Additionally, a phasing plug made of a low-loss high-density composite may increase sensitivity by more than about 1 dB when compared to phase plugs fabricated from expanded polystyrene or similar materials.

The phasing plug 104 can regulate the surface area through which air can pass by restricting the surface area of the slots opposite the diaphragm. Thus, the phasing plug 104 can increase the air pressure in front of the diaphragm by decreasing the surface area through which air can pass in relation to the surface area of the diaphragm. The ratio of slot surface area to diaphragm surface area may be referred to as a compression ratio. Thus, if the combined slot openings provide 1 $cm^2$ of surface area for air to exit and the surface area of the diaphragm is 20 $cm^2$, a 1:20 compression ratio can be achieved. The compression ratios may range between about 1:1 and about 1:20. The compression ratios range between about 1:4 and about 1:14. The compression ratios may range between about 1:6 and about 1:11. The compression ratio may be between about 1:7 and about 1:8. Other compression ratios may be used.

In free-air, the force required to maintain substantially uniform movement of the diaphragm can be very small, such that any deviation from the desired movement is large in relation to the force required to move the diaphragm. The loudspeaker 100 compresses air directly in front of the diaphragm to a much higher pressure, which increases the force required to move the diaphragm in a substantially uniform fashion. By increasing the force in this manner, deviations from substantially uniform diaphragm movement become small in relation to the force required to move the diaphragm. The result is a better matching of acoustical impedances in the loudspeaker. Acoustical impedance, in units of mechanical ohms, is a complex variable having both magnitude and phase. It is defined as the ratio of acoustical pressure to the acoustical volume velocity. Generally, this acoustical relationship expresses the relationship between the ability to move a volume of air and the pressure generated by any impedance to that air movement.

The phasing plug 104 provides an approximately flat or planar acoustic wave front. A substantially planar acoustic wave front is produced when the distance from any point on the surface of the diaphragm to the exit of the phasing plug is approximately equal. The closer to equal the distances are, the more secondary effect, such as acoustical modal resonances between the diaphragm and annular rings, are reduced. In the phasing plug 104, the distances may be optimized to be about equal, thus minimizing secondary effects.

The phasing plug 104 also may provide a uniform acoustic flare rate. Acoustical flare rate is the rate at which a sound wave expands as it travels through the phasing plug 104. The acoustical flare rate is calculated in units of Hertz (Hz) and can be expressed in terms of a mathematical relationship that is smoothly increasing in value without discontinuity, such as a first or second derivative. The expansion also can be exponential, hyperbolic, conical, parabolic, or linear. The slots can be formed in the phasing plug to provide an acoustic flare rate that increases uniformly in relation to distance from the diaphragm.

EXAMPLE

Horn-Loaded Compression Driver

A driver was constructed using an eight inch cone midrange transducer, a 3-slot annular-ring phasing plug, and a horn with a 4 inch diameter throat. The driver has a bandwidth of approximately 250 Hz to 2.2 kHz and a rated power handling capacity of approximately 300 watts. The typical 1 watt/1 meter sensitivity is 107 dB SPL on a 90°×50° waveguide. Due to true pistonic response within the recommended pass-band, response deviations of less than ±0.5 dB result with simple constant directivity equalization. Maximum continuous sound pressure level (SPL) is greater than 133 dB at 1 meter on all appropriate waveguides. The horn-load compression driver may have other configurations including fewer or additional components.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A horn-load compression driver system, comprising:

a phasing plug disposed between a throat of a horn and a diaphragm in a transducer, where the phasing plug has multiple annular rings forming multiple slots and a common annular chamber disposed adjacent to the throat of the horn, where each slot has a path length extending from the diaphragm to a common focal point in the common annular chamber, a centerline of each slot intersecting near the common focal point in the common annular chamber, and where the common focal point has a common path length extending from the common focal point to the throat of the horn.

2. The driver system of claim 1, where the common annular chamber expands uniformly in cross-sectional area.

3. The driver system of claim 1, where each slot expands uniformly in cross-sectional area.

4. The driver system of claim 1, where the path lengths of each slot are about equal.

5. The driver system of claim 1, where the compression ratio of the phasing plug is in the range of about 1:1 through about 1:20.

6. The driver system of claim 1, where the compression rate of the phasing plug is in the range of about 1:7 through about 1:8.

7. The driver system of claim 1, where the phasing plug provides an approximately flat acoustic wave front to the horn.

8. The driver system of claim 1, where the phasing plug is disposed about 0.075 inches from the diaphragm.

9. A phasing plug for a loudspeaker, comprising:

at least three annular rings forming at least two slots and a common annular chamber, where each slot extends from an inlet side to the common annular chamber, where the common annular chamber extends from the slots to an outlet side defined by at least two annular rings, where each slot has a path length from the inlet side to a common focal point in the common annular chamber, a centerline of each slot intersecting near the common focal point in the common annular chamber, and where the common annular chamber has a common path length extending from the common focal point to the outlet side.

10. The phasing plug of claim 9, where the common annular chamber expands uniformly in cross-sectional area.

11. The phasing plug of claim 9, where the at least two slots each expand uniformly in cross-sectional area.

12. The phasing plug of claim 9, where the path lengths of each slot are about equal.

13. The phasing plug of claim 9, comprising:

a support annular ring, an outer annular ring, an inner annular ring, and a center annular ring, where the support annular ring and the outer annular ring form an outside slot, where the outer annular ring and the inner annular ring form a center slot; and where the inner annular ring and the center annular ring form an inside slot.

14. The phasing plug of claim 9, where the compression ratio of the at least two slots is in the range of about 1:1 through about 1:20.

15. The phasing plug of claim 9, where the compression ratio of the at least two slots is in the range of about 1:7 through about 1:8.

16. The phasing plug of claim 9, where the common annular chamber provides an approximately flat acoustic wave front.

17. A loudspeaker, comprising:

a transducer connected to a horn, where the transducer has a diaphragm; and a phasing plug disposed between the transducer and a throat of the horn, the phasing plug having an inlet side and an outlet side, the inlet side adjacent to the diaphragm, the outlet side adjacent to the throat of the horn, where the phasing plug forms at least two slots and a common annular chamber disposed adjacent to a throat of the horn, where each slot has a path length from the inlet side to a common focal point in the common annular chamber, a centerline of each slot intersecting near the common focal point in the common annular chamber, where the common annular chamber has a common path length from the common focal point to the outlet side adjacent to the throat of the horn.

18. The loudspeaker of claim 17, where the common annular chamber expands uniformly in cross-sectional area toward the outlet side.

19. The loudspeaker of claim 17, where the at least two slots each expand uniformly in cross-sectional area from the inlet side.

20. The loudspeaker of claim 17, where the path lengths of the at least two slots are about equal.

21. The loudspeaker of claim 17, where the horn forms a throat and a mouth, and where the outlet of the phasing plug is disposed adjacent to the throat.

22. The loudspeaker of claim 21, where the common annular chamber has an exit with a cross-sectional area about equal to a cross-sectional area of the throat of the horn.

23. The loudspeaker of claim 22, where the cross-sectional area of the throat of the horn has a radius of about 4 inches.

* * * * *